United States Patent [19]

Moeneclaey et al.

[11] Patent Number: 4,781,226

[45] Date of Patent: Nov. 1, 1988

[54] DRIVING AND CONTROL MECHANISM FOR CLAMPING, PRESENTATION AND FASTENING OF WEFT THREADS IN GRIPPER WEAVING LOOMS

[75] Inventors: Denis Moeneclaey, Roeselare; Remi Lagache, Zillebeke-Ieper; Johnny Victoor, Langemark; Lucien Coopman, Zonnebeke, all of Belgium

[73] Assignee: Picanol N.V., Belgium

[21] Appl. No.: 33,740

[22] Filed: Apr. 3, 1987

[30] Foreign Application Priority Data

Apr. 3, 1986 [NL] Netherlands ..... 8600858

[51] Int. Cl.[4] ..... D03D 47/38

[52] U.S. Cl. ..... 139/453

[58] Field of Search ..... 139/453, 450; 66/127

[56] References Cited

U.S. PATENT DOCUMENTS 4,076,054 2/1978 Merisio ..... 139/453

4,191,222 3/1980 Marshall ..... 139/453

FOREIGN PATENT DOCUMENTS 897288 11/1983 Belgium .

*Primary Examiner*—Henry S. Jaudon

*Attorney, Agent, or Firm*—Bacon & Thomas

[57] ABSTRACT

A driving and control mechanism for clamping, presenting and holding weft threads on gripper weaving looms is disclosed, whereby at least one thread presentation element (1) can be moved to various positions. The mechanism is composed of at least two levers (5, 6) which are attached in a common manner with a coupling connecting the levers (5, 6) to a thread presentation element (1), a cam transmission (8, 9) for moving the levers (5, 6) locking device (10) which can actuate the lever arms (17, 18) located opposite to the lever arms (12, 13) attached to the coupling (7); and a control system (11) for actuating the locking device (10).

13 Claims, 3 Drawing Sheets

DRIVING AND CONTROL MECHANISM FOR CLAMPING, PRESENTATION AND FASTENING OF WEFT THREADS IN GRIPPER WEAVING LOOMS

BACKGROUND OF THE INVENTION

The present invention concerns a driving and control mechanism for a device for clamping, holding and presenting weft threads in gripper weaving looms. The mechanism is designed to move thread presentation elements, such as thread clamps or thread eyelets to various positions in relationship to the shed.

According to a preferred embodiment, the invention concerns a driving and control mechanism, that is particularly suitable for driving and controlling thread clamps. The thread clamps are able to take three positions as described in detail in U.S. patent application Ser. No. 033,739 of the applicant. This application describes a method for weaving without waste on the weft insertion side whereby, in a first position, such a thread clamp is in motionless condition; in a second position the thread clamp is presented in such a way that the clamped thread is brought into the path of a gripper and, whereby, in a third position, the clamp is positioned near the cloth edge in such a way that the weft thread introduced into the shed by means of the beating movement of the reed is pushed back into the clamp.

The present invention concerns a driving and control mechanism for such clamps, whereby during two successive cycles of such a clamp, it may not be brought back to the first position, but may directly be brought from the aforesaid third position to the aforesaid second position.

Belgian patent No. 897,288 describes presentation needles which are driven by means of levers mounted on cam wheels and which are connected on one side to the presentation needles while their other end can be held by means of connectable hook elements. These hook elements can only be engaged with the levers when the presentation needles are in their motionless position. This design has, however, the disadvantage that it is not applicable for regulation whereby, as already mentioned, the thread presentation elements arrive only for a short while at their motionless position or not at all in the case of overlapping cycles.

SUMMARY OF THE INVENTION

The present invention relates to a driving and control mechanism for thread presentation elements in gripper weaving looms, that does not have the aforesaid disadvantage and one that makes possible a large range of movement possibilities for the thread presentation elements.

To this end, the present invention comprises a driving and control mechanism for thread presentation elements in gripper weaving looms, whereby at least one thread presentation element can be moved into different positions, whereby the selection does not take place in one of the outer positions. This mechanism is characterized by the fact that it comprises a combination of: for each thread presentation element, at least two levers cooperating with one lever arm in a common manner with coupling means, whereby the coupling means achieve the connection between the levers and the thread presentation element; cam transmissions for moving the levers; locking means able to act on the levers located opposite to the lever arms cooperating with the coupling means; and control means for controlling the locking means.

BRIEF DESCRIPTION OF THE DRAWINGS

In order that the characteristics of the invention are better understood, a few preferred embodiments will be described hereafter without any limitative character and with reference to the figures in which.

DETAILED DESCRIPTION OF THE PREFERRED EMBODIMENTS

Figure 1:
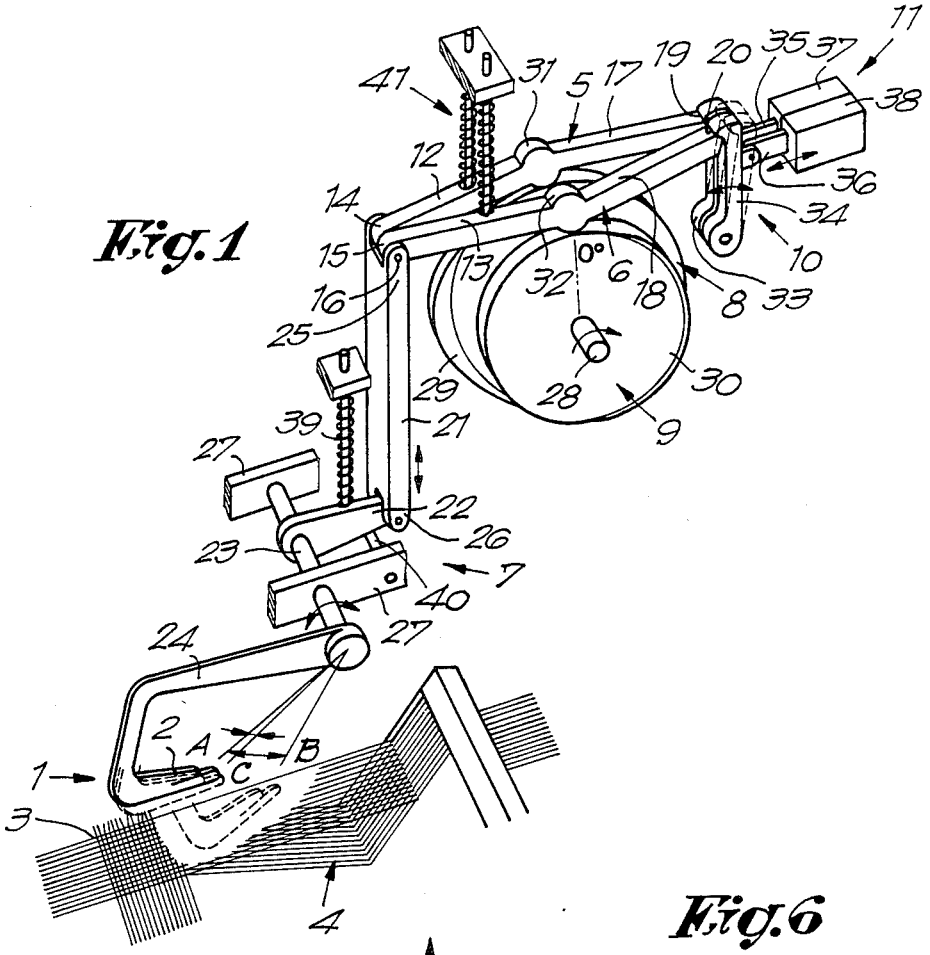
FIG. 1 is a partial, perspective illustration of a driving and control mechanism for a thread presentation element in accordance with the invention.

FIG. 1 illustrates an embodiment of the invention, whereby a thread presentation element 1 as described in U.S. patent application Ser. No. 033,739 mainly composed of a thread clamp 2, must be controlled in such a way that it can take three positions, respectively A, B and C, near the cloth edge 3, and more specially on the weft insertion side of the shed 4.

The driving and control mechanism in accordance with the invention comprises two levers 5 and 6; coupling means 7 which connects the levers 5 and 6 and the thread presentation element 1; cam transmissions 8 and 9 for moving the levers 5 and 6; locking means 10; and control means 11 for controlling the locking means 10.

The levers 5 and 6 are mounted near each other in the embodiment of FIG. 1 and can move along parallel planes in such a way that they can cooperates with one of their lever arms, respectively 12 and 13 and in a common manner with the coupling means 7. To this end the lever arms 12 and 13 are pivotally connected at their ends, respectively 14 and 15, to each other as well as with the coupling means 7, for instance by means of a shaft 16. The other lever arms, respectively 17 and 18, cooperate with their ends 19 and 20, with the locking means 10.

According to the embodiment of FIG. 1, the coupling means 7 comprises a connecting rod 21, a crankshaft 22 that is fastened on the shaft 23 and an arm 24 fastened on this shaft.

The connecting rod 21 is pivotally connected at one end 25 by means of shaft to the levers 5 and 6. At its other end 26, the connecting rod 21 is coupled to the crankshaft 22. The shaft 23, whereon the crankshaft 22 is fastened, is rotatably supported in the frame 27 of the apparatus.

The thread presentation element 1 is supported by the end of the aforesaid rotatable arm 24.

The cam transmissions 8 and 9 each comprise a cam wheel, respectively 29 and 30, mounted on a common driving shaft 28, whereby these cam wheels bear against the levers 5 and 6 in their centers, respectively cam followers 31 and 32.

The locking means 10 illustrated in FIG. 1 comprises rotatable hook elements 33 and 34 that can engage the ends 19 and 20 of the levers 5 and 6, whereby the upwards movement of these ends 19 and 20 can be prohibited. The control means 11 used to this end are, for instance, of the electro-magnetic type and c o mprise, as illustrated in FIG. 1, rods 35 and 36 that can be moved by means of electro-magnets 37 and 38, and displace the rotatable hook elements 33 and 34.

FIG. 1 illustrates also elastic means designed to bring always the clamp 2 to an initial motionless condition, which is position A in the present case. These means are composed, for instance, of a compression spring 39 which urges the crankshaft 22 downwards. In order to limit the movement, a stop 40 is provided. The levers 5 and 6 can also be equipped with elastic means 41 in order to ensure contact between the cam followers 31 and 32 of levers 5 and 6, the cam wheels 29 and 30 at high speeds of the driving shaft 28. These latter elastic means 41 can also be used in order to move the whole assembly to the initial motionless position instead of obtaining this result by means of a spring 39.

The functioning of the driving and control mechanism in accordance with the invention is described hereafter. When the locking means 10 disengaged from ends 19 and 20 of levers 5 and 6 as illustrated with dotted lines in FIG. 1, the thread presentation element 1 is kept in the initial A position by means of a compression spring 39 acting on the coupling means 7. Consequently the levers 5 and 6 are moved up and down by contact of their followers 31 and 32 with cam wheels 29 and 30 whereby the only result of this movement is an up and down displacement of the ends 19 and 20 of the lever arms 17 and 18, while the coupling means 7 are not moved.

When the locking means 10 are brought into service by means of the control elements 11, the hook element 33 is engaged according to the illustrated embodiment with the end 19 of the lever arm 17. As soon as the lever 5 is pushed upwards by contact between its follower 31 and cam wheel 29, the levers 5 and 6 are also pushed upwards at their coupled ends 14 and 15, whereby the coupling means 7 are moved against the force of the spring 39 and of the elastic means 41, in such a way that the thread clamp 2 is moved to another position. In this case, the movement of the thread clamp 2 is determined by the shape of the cam wheel 29.

After clamp 2 reaches the B position, the hook element 34 is also brought into its operative position near the end 20 of the lever 6. If the cam transmissions 8 and 9 are rotated further, the lever 5 is moved downwards by means of its contact with follower 31 and the cam wheel 29. As the ends 14 and 15 of the levers 5 and 6 are coupled with each other, the lever 6 rotates about its follower 32 over the cam wheel 30 until the end 20 comes into contact with the hook element 34. At this moment, the cam wheel 30 determines the movement of the lever 6 and a while in the C position.

During these periods the hook element 33 will be retracted.

When the cam wheel 30 is rotated further, the follower 32 of the lever 6 is also moved downwards, whereby the clamp 2 returns to its initial motionless position A. At that moment, hook element 34 is retracted and the end 20 of the lever 6 is free again.

The downwards movement of the ends 14 and 15 of the levers 5 and 6 and, consequently, also the downwards movement of the coupling means 7 take place by means of the spring 39 and of the elastic means 41.

The movement of the thread clamp 2 is caused by the levers 5 or 6 which undergo the largest upwards displacement caused by the cam transmissions 8 or 9.

Figure 2:
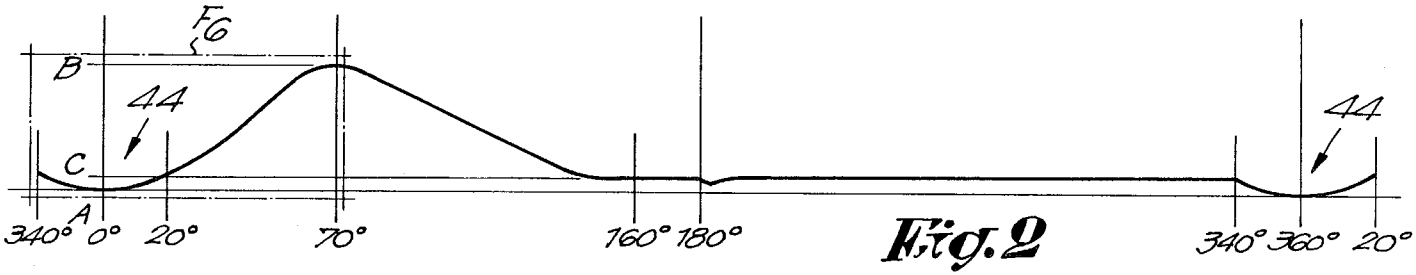
FIG. 2 is a graph indicating the movement of the thread presentation element of the embodiment in accordance with FIG. 1.

FIG. 2 illustrates a complete revolution of the driving shaft 28 and the corresponding movement of the thread clamp 2 by means of the mechanism illustrated in FIG. 1. The locking means 10 must obviously be brought into service in this case.

The thread clamp 2 is brought from the initial motionless A position to the B position following an initial angular rotation of shaft 28 and is moved afterwards to an intermediate C position during a large part of the revolution cycle. The curve of FIG. 2 also illustrates the movement of the connecting rod 21.

Figure 3:
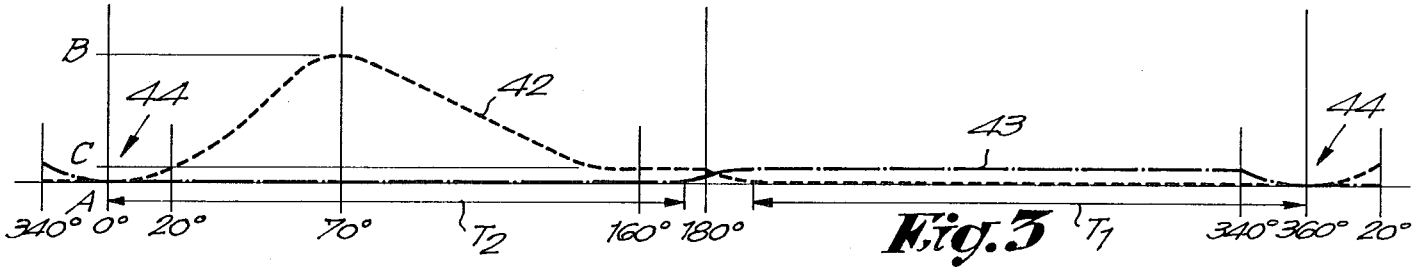
FIG. 3 is a graphical analysis of the curve in FIG. 2, whereby each of the curves illustrated corresponds to separate movements obtained by means of the aforesaid different levers.

The movement obtained from cam wheel 29 by locking the lever 5 is illustrated in FIG. 3 by curve 42. On the other hand, the movement from cam wheel 30 by locking the lever 6 is illustrated on curve 43. Quite obviously, the curve of FIG. 2 is a combination of both curves 42 and 43, whereby it assumes at each moment, the profile of curves 42 or 43 having the largest instantaneous amplitude.

FIGS. 2 and 3 illustrate also very clearly the advantage of the use of the two levers 5 and 6. If, by means of one lever, a movement must be applied to a thread clamp 2, as illustrated by the curve of FIG. 2, the cam wheel must be designed in such a way that the cam curve has the same shape as the curve of FIG. 2. The lever end cooperating with the locking means comes only for a short while in its lowest A position, in such a case whereby this position is determined by the lowest points 44 of the curve of FIG. 2.

As this lever is able to cooperate with the locking means only at these moments, practically no time is made available for switching on or off the locking means. Practically no movement of a thread clamp, as illustrated by the curve of FIG. 2 can be achieved by means of a device comprising only one lever and one cam wheel.

FIG. 3 clearly illustrates the fact that the previous problem is no longer existing if two or more levers are used, for instance 5 and 6 which are actuated by separate cam transmissions 8 and 9. For an adequate shape of the cam wheels 29 and 30, it is possible to foresee two periods T1 and T2, during which the hook elements 33 and 34 are able to engage the levers 5 and 6, whereby these periods T1 and T2 now correspond to more or less half of the time required for a revolution of the driving shaft 28.

Figure 4:
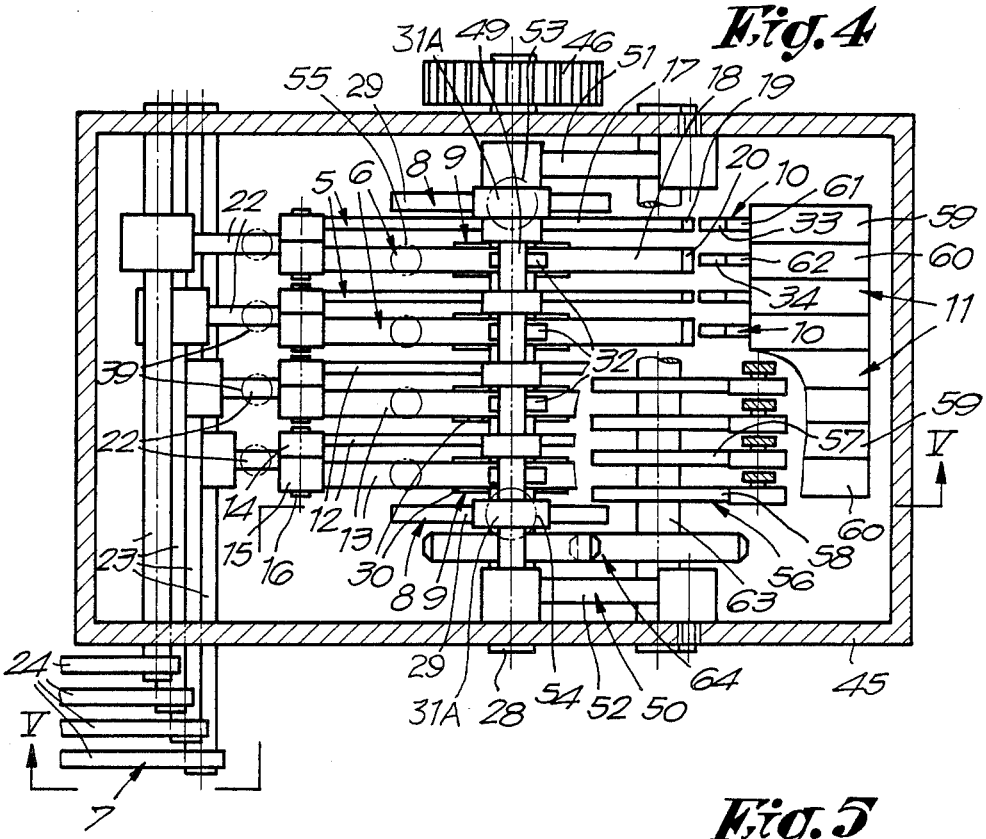
FIG. 4 is a top view of a driving and control mechanism according to the invention whereby four thread presentation elements are driven.
Figure 5:
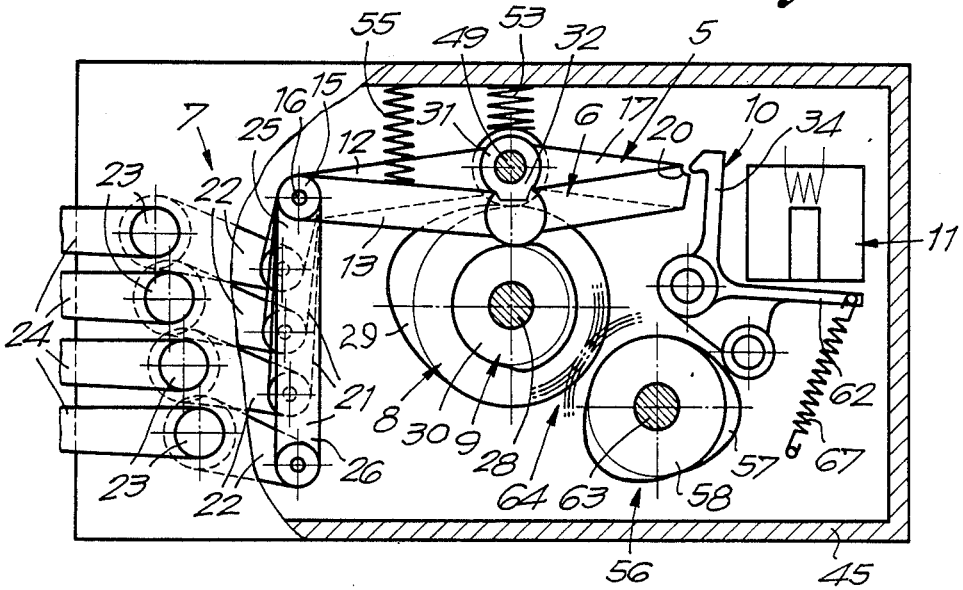
FIG. 5 is a cross-section taken along line V—V in FIG. 4.

FIGS. 4 and 5 illustrate an embodiment of a driving and control mechanism for four thread presentation elements. The mechanism mainly comprises the combination of four mechanisms as illustrated in FIG. 1, whereby these four elements are mounted on a common driving shaft 28.

The corresponding parts are thus indicated by the same reference numbers.

As shown in FIGS. 4 and 5, the whole assembly is mounted in a casing 45, whereby the arms 24 as well as a part of the shaft 28 are located outside casing 45 and whereby this part of the shaft 29 is equipped with a toothed belt pulley 46 that can be coupled to the main transmission (not shown) of the weaving loom.

Another specific characteristic of the embodiment according to FIGS. 4 and 5 is related to the fact that the cam transmission 8 of the four levers 5 is built in a common manner. To this end, the cam transmission is composed of two cam wheels 29; a shaft 49 supporting cam followers 31; and of means 50 for fastening shaft 49 at its ends to the casing 45 for adequate movement. The cam wheels 29 are mounted respectively along both sides of the lever system while the shaft 49 supports four levers 5.

The means 50 providing the movable fastening of the shaft 49 comprise crankshafts 51 and 52 that are coupled each at one end to the shaft 49 and that are pivotally supported at their other end in the casing 45 whereby the pivot center is on the same line as the points of contact between the ends 19 and the hook element 33.

Two compression springs 53 and 54 urge cam followers 31A supported on shaft 49 into contact with the cam wheels 29. The springs 55 urge cam followers 32 on levers 6 into contact with corresponding cam wheels 30.

The control means 11 comprise a cam transmission 56, having for each hook element 33 and 34 a cam wheel 57 and 58, respectively, as well as electro-magnets 59 and 60 which cooperate in known fashion with the lever arms 61 and 62 fastened to the hook elements 33 and 34.

The cam wheels 57 and 58 are mounted on a common shaft 63 which is coupled to the driving shaft 28 by means of a gear transmission 64. The cam wheels 57 and 58 push the lever arms 61 and 62 against the electro-magnets 59 and 60 once for each revolution of shaft 63.

Figure 7:
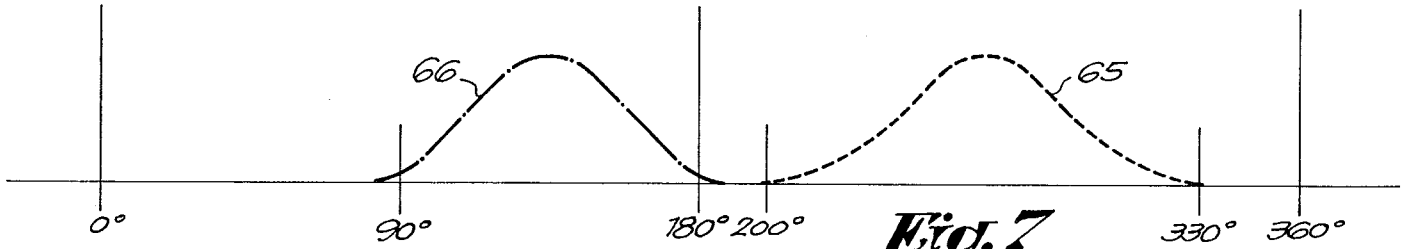
FIG. 7 is a graph illustrating the cam pattern of a cam transmission that is part of the aforesaid control means, according to a specific embodiment, in order to control the locking means.

To obtain the movements illustrated by the curves of FIGS. 2 and 3, the lever arms 61 and 62 must be actuated respectively during the periods T1 and T2. The cam curves 65 and 66 for the cam wheels 57 and 58 are illustrated in FIG. 7. Retracting means 67 are attached to the lever arms 61 and 62 to return them to their retracted positions.

The functioning of the driving and control mechanism for thread presentation elements according to FIG. 5 is essentially corresponding to the working of the embodiment according to FIG. 1.

The thread clamp 2 is put into operation in the following manner. When a thread clamp 2 is selected, the corresponding electro-magnet 59 is energized. By means of the cam wheels 57, all lever arms 61 are pushed against their respective electro-magnets, following the curve 65. Only the lever arm 61 which is cooperating with the switched-on electro-magnet 59 will be kept at its highest position during the folloiwng cycle, while the other lever arms 61 will be kept in contact with their cam wheels 57 by means of the retracting means 67.

The lever arm 61 held by the electro-magnet 59 engages the hook element 33 with the end 19 of the corresponding lever 5. The functioning is then similar to that of the embodiment described in accordance with FIG. 1 and the clamp is moved to the B position.

The movement of the clamp 2 from the second B position to the waiting condition of the C position will occur as follows. The corresponding magnet 60 is energized. By means of the cam wheels 58 all lever arms 62 are pushed against the electro-magnet 60 as indicated by curve 66 in FIG. 7. Only the lever arm 62 that is cooperating with the switched-on electro-magnet 60, and thus the lever arm of the clamp 2 just selected and moving along curve 42, will be kept in the highest position during the continuation of the cycle, while the other lever arms 62 will be kept in contact with the cam wheels 58 by means of the retracting means 67. The downwards forces applied afterwards by the cam transmission 8 to the levers 5 and the upwards forces applied by the cam transmission 9 to the levers 6 keep the selected clamp 2 in the C position, while, by the cooperation of the corresponding lever 6 with the cam transmission 9 and the hook element 34, the clamp 2 is held in the C position during a part of the cycle. Meanwhile, the hook element 33 that was engaged with lever 5 is retracted to free end 19 of the lever. Subsequently, a new selection can be carried out for the lever 61 and the hook element 33.

Quite obviously various alternative solutions for the driving and control mechanism in accordance with the invention are possible. For instance locking means 10 other than hook elements 33 and 34 may be resorted to.

The coupling means 7 may comprise for instance, a rod that is directly connected to the thread clamp 2, whereby the thread clamp 2 can be moved vertically up and down.

Moreover, various movements can be applied to the thread presentation element 1 by means of a driving and control mechanism in accordance with the invention, and it is obvious that the movements, as well as the shapes of the cam wheels 29 and 30, as illustrated in FIGS. 2 and 3 are given only by way of examples.

According to an alternative solution that is not illustrated in the figures, the two levers 5 and 6 may also be mounted in a common plane, whereby the cam transmissions 8 and 9 are mounted on the left and right hand sides of and near the coupling means 7.

According to still another alternative solution, the cam wheels 8 and 9 as well as the levers 5 and 6 can be mounted one above the other, whereby, for instance, in the embodiment according to FIG. 1 the end 14 of the lever 5 cooperates with the end 25 of the connecting rod 21, while the end 13 of the lever 6 cooperates with the lowest end 26 of the connecting part 21.

Figure 6:
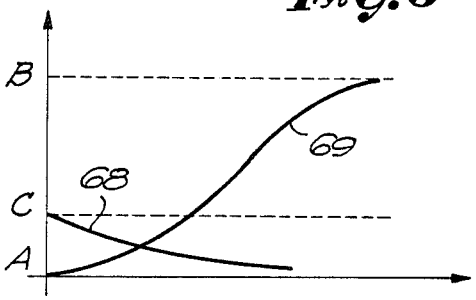
FIG. 6 is an enlarged graph of the part of FIG. 2 indicated by F6, whereby the overlapping of two weaving cycles is illustrated.

The use of two or more levers has the advantage that overlappingmovements of two thread presentation elements 1 can occur as illustrated on the diagram of FIG. 6. The movement according to curve 68 (which is an alternative to the curve 43) of FIG. 6 for the thread presentation element 1 which was the last in working must not necessarily be finished at the beginning of the movement, according to curve 69 (which is an alternative to curve 43) for the next thread presentation element to be activated.

The present invention is by no means limited to the embodiments described hereabove by way of examples and illustrated in the figures, but such a driving and control mechanism for thread presentation elements of gripper weaving looms can be carried out in many shapes and sizes without departing from the scope of the invention.

We claim:

1. A driving and control mechanism for moving at least one clamping device on a gripper weaving loom between a plurality of positions for clamping, presenting and holding a weft thread comprising:

(a) at least first and second operating levers, each lever having a first end, a central portion and a second end;

(b) coupling means connecting the first ends of both levers to the clamping device;

(c) cam transmission means having separate cam elements acting on each lever;

(d) locking means to selectively engage the second end of either operating lever such that the lever so engaged controls the movement of the clamping device; and (e) control means to control the activation of the locking means.

2. The driving and control mechanism according to claim 1 wherein the cam elements operatively act on the center portions of the respective levers.

3. The driving and control mechanism according to claim 1 further comprising a common driveshaft to rotate all cam elements.

4. The driving and control mechanism according to claim 1 wherein the cam transmission means comprises:

(a) first cam wheels defining first cam surfaces;

(b) first cam follower means operatively contacting the first cam surfaces;

(c) a common shaft interconnecting the first cam follower means and all of the first operating levers;

(d) second cam wheels defining second cam surfaces operatively contacting the second levers.

5. The driving and control mechanism according to claim 4 further comprising a separate second cam wheel for each second lever.

6. The driving and control mechanism according to claim 1 wherein the coupling means comprises:

(a) a connecting rod having a first end coupled to the first ends of the first and second operating levers and a second end;

(b) rotatable shaft means fixedly attached to the clamping device; and, (c) a crankshaft fixedly secured to the rotatable shaft and connected to the second end of the connecting rod.

7. The driving and control mechanism according to claim 6 further comprising first spring means acting on the operating levers to bias the clamping device toward a first position.

8. The driving and control mechanism according to claim 7 further comprising second spring means acting on the crankshaft to bias the clamping device toward its first position.

9. The driving and control mechanism according to claim 1 further comprising biasing means acting on the first and second levers to bias the levers into operative contact with the cam transmission means.

10. The driving and control mechanism according to claim 1 wherein the locking means comprising:

(a) first and second hook elements located adjacent the second ends of the first and second operating levers, respectively, each hook element movable between an extended position wherein it engages the second end of the respective lever and a retracted position wherein it is withdrawn from the respective lever; and, (b) means for moving each hook element between its extended and retracted positions.

11. The driving and control mechanism according to claim 10 wherein the means for moving the hook elements comprises a second cam transmission.

12. The driving and control mechanism according to claim 11 further comprising biasing means to bias the hook elements toward their retracted positions.

13. The driving and control mechanism according to claim 12 further comprising electro-magnetic means acting on each hook element to hold the element in its extended position.

* * * * *